United States Patent [19]

Schenker

[11] Patent Number: 4,600,187

[45] Date of Patent: Jul. 15, 1986

[54] STEP EXERCISER

[76] Inventor: Bruce R. Schenker, 2600 Hampton Ave., Allison Park, Pa. 15101

[21] Appl. No.: 749,678

[22] Filed: Jun. 28, 1985

[51] Int. Cl.[4] ..... A63B 23/04

[52] U.S. Cl. ..... 272/70; 272/70.2; 272/131

[58] Field of Search ..... 272/96, 69, 70, 70.2, 272/131

[56] References Cited

U.S. PATENT DOCUMENTS

| | | | |
|---|---|---|---|
| 3,511,500 | 5/1970 | Dunn | 272/70 |
| 3,747,924 | 7/1973 | Champoux | 272/121 |
| 4,159,111 | 6/1979 | Lowth | 272/96 |
| 4,496,147 | 1/1985 | DeCloux et al. | 272/130 |

FOREIGN PATENT DOCUMENTS

| | | | |
|---|---|---|---|
| 2010101 | 6/1979 | United Kingdom | 272/70 |

*Primary Examiner*—Richard J. Apley
*Assistant Examiner*—John L. Welsh
*Attorney, Agent, or Firm*—William J. Ruano

[57] ABSTRACT

An exercising device simulating walking up steps. A pair of step treads are rigidly supported at a slight angle on the ends of a pair of step arms pivoted at the other ends on the bight portion of a "U"-shaped frame. A rocker plate is connected between the step arms and is adjustably braked by a pair of brake shoes rigidly connected to a cross arm connecting the legs of the "U". The cross arm is selectively attached to different portions of the arms of the "U"-shaped frame together with the rocker plate and brake shoes for adjusting the height of the steps. Support blocks are connected underneath the step treads to provide different angles of inclination of the step treads and accomplished by partial rotation of the blocks.

4 Claims, 3 Drawing Figures

STEP EXERCISER

This invention relates to a foot and leg exercising device so constructed as to simulate walking up a pair of steps.

BACKGROUND OF THE INVENTION

In the past, foot exercisers have been devised as described in the following U.S. Patents:

U.S. Pat. No. 4,159,111—dated June 26, 1979
U.S. Pat. No. 3,511,500—dated May 12, 1970
U.S. Pat. No. 3,792,860—dated Feb. 19, 1974
U.S. Pat. No. 2,253,996—dated Aug. 26, 1941
U.S. Pat. No. 3,970,302—dated July 20, 1976

An outstanding disadvantage of the foot exercisers described in said prior patents is that no satisfactory adjustability is provided to regulate the height of the steps or to confine movement to a substantially vertical plane as occurs in walking up steps and to provide variable resistance to foot and leg movements and, above all, simplicity and economy in construction.

An object of the present invention is to overcome the above-named disadvantages by confining the step movements to almost vertical movements, rather than wide arcuate movements, and to provide easy adjustability of the height of the steps and their inclination as well as provide a compact exerciser of relatively simple construction which is easy to store in one's cupboard, and which is inexpensive to manufacture.

Other objects and advantages of the invention will become more apparent from a study of the following description taken with the accompanying drawing wherein.

DETAILED DESCRIPTION OF THE DRAWING

Figure 1:
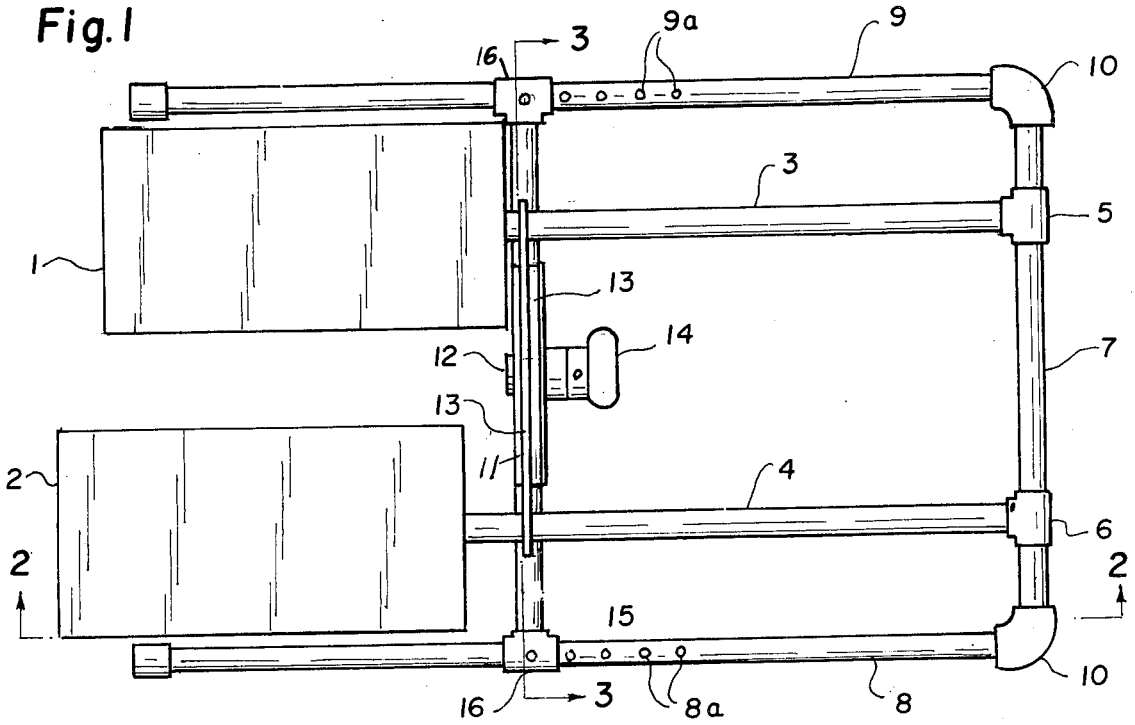
FIG. 1 is a top view of a step and leg exerciser embodying the present invention.
Figure 2:
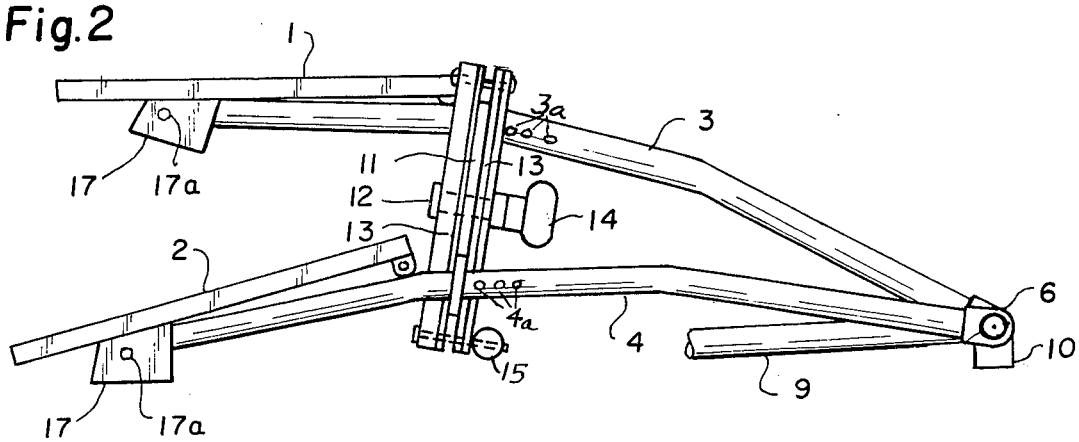
FIG. 2 is a side or elevation view thereof taken along line 2—2 of FIG. 1.
Figure 3:
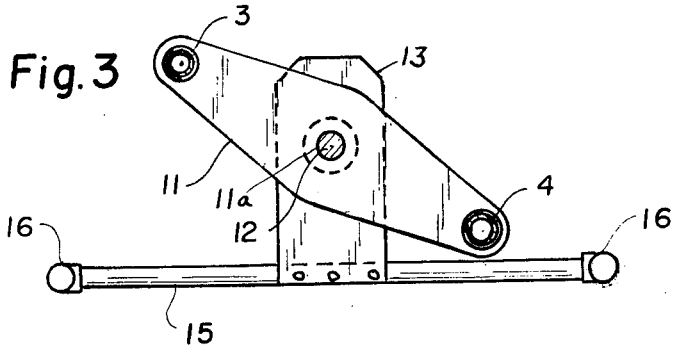
FIG. 3 is a sectional view thereof taken along line 3—3 of FIG. 1.

Referring more particularly to FIG. 1 and FIG. 2 of the drawing, numerals 1 and 2 denote a pair of step treads which are rigidly attached to step arms 3 and 4 at a slight angle, which arms may be in the form of hollow tubular members or pipes which are pivotally mounted by means of Tees 5 and 6, which are loosely pivoted on the pivot arm or pipe 7 of a "U"-shaped tubular base comprising side arms 8 and 9, also, preferably of tubular or pipe construction. A pair of supports 10,10 are provided at the corners of the "U" which are in the form of a pipe connection having three legs disposed at right angles to each other as shown in FIGS. 1 and 2.

A rocker plate 11 is provided with a pair of holes which loosely fit about step arms 3 and 4. The center of the rocker plate 11 has hole 11*a* through which a bolt 12 extends. The rocker plate 11 is selectively braked by means of concentrically mounted brake shoes 13,13 having bottom edges which are rigidly secured to a cross arm or support 15. A handle 14 is screw threaded to bolt 12 so as to selectively compress the rocker plate 11 between the brake shoes 13,13 so as to provide selective resistance to rocker movements of step treads 1 and 2 about the bolt 12 as a pivot.

Various adjustments are provided to vary the amount of exercise obtainable by the device. Cross arm 15 may be adjustably slid by end T's 16 along arms 8 and 9 of the "U"-shaped base and attached to selective openings 8*a* and 9*a* by means of pins so that by moving the cross arm 15 towards the pivot arm 7, the step will be made higher. Plate 11 is adjustably slid to holes 3*a*, 4*a*.

A pair of blocks 17 are attached to the lower surface of the foot treads 1 and 2 and are provided with surfaces which are off-center with respect to a bolt 17*a* so that by selecting the particular surface to contact the under surface of the step tread,—that is, by selectively rotating block 17 at 90° increments, different heights may be attained between the heels of the step treads and the ends of the step arms 3,4 changing the inclination of the step treads. Of course, by tightening the handle 14, the brake shoes are selectively brought closer together to provide greater friction for resisting rocker rotation of the rocker plate 11.

Thus it will be seen that I have provided an efficient exercising machine to simulate a pair of steps, which machine provides an easily achieved work load and aerobic effect equivalent to much more athletic exercises; uses the largest muscle groups to lift up to one's own weight, allows movement through the depth of the step a given number of times a minute; adjusts tension, step angle, step height, and frequency of step for anything from a light to a heavy workout; builds definition and strength of leg muscles—and, by an adjustable tread incline, provides for more or less of the work load on the calf muscles, and the adjsutable step height provides for more or less of the work load on the back leg muscles; also provides an effective workout, and which is handy to use even in a small area and is easy to store standing or hanging in a closet.

While I have illustrated and described a single specific embodiment of my invention, it will be understood that this is by way of illustration only and that various changes and modifications may be contemplated in my invention within the scope of the following claims.

I claim:

1. A foot and leg exercising device for simulating walking up steps, comprising a support having parallel side arms interconnected at one end by a right angularly extending pivot arm, a pair of step treads attached to one end of a pair of step arms, said step arms being loosely pivoted at their other end to said pivot arm, a cross arm having ends connected to an intermediate portion of said side arms, a brake shoe upstanding from and rigidly connected to the central portion of said cross arm, a rocker plate pivotally mounted on said brake shoe and having openings at the ends thereof which loosely fit on said step arms, and bolt means for selectively compressing said rocker plate against said brake shoe to vary the resistance against rocker movements of said rocker plate.

2. An exercising device as recited in claim 1 together with means for adjusting the longitudinal position of attachment of said cross arm to said side arms so as to vary the height of movement of said step treads.

3. An exercising device as recited in claim 2 wherein said step treads are angularly disposed relative to said step arms.

4. An exercising device as recited in claim 2 wherein said support is in the form of piping connected by elbows and wherein said elbows have a third arm extending downwardly at right angles to form legs.

* * * * *